US011512849B2

(12) United States Patent
Brückner et al.

(10) Patent No.: US 11,512,849 B2
(45) Date of Patent: Nov. 29, 2022

(54) STEAM GENERATOR PIPE HAVING A TURBULENCE INSTALLATION BODY

(71) Applicant: Siemens Energy Global GmbH & Co. KG, Munich (DE)

(72) Inventors: Jan Brückner, Uttenreuth (DE); Martin Effert, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/089,588

(22) PCT Filed: Apr. 19, 2017

(86) PCT No.: PCT/EP2017/059227

§ 371 (c)(1),
(2) Date: Sep. 28, 2018

(87) PCT Pub. No.: WO2018/007036

PCT Pub. Date: Jan. 11, 2018

(65) Prior Publication Data

US 2019/0120482 A1 Apr. 25, 2019

(30) Foreign Application Priority Data

Jul. 7, 2016 (DE) ..... 10 2016 212 416.1

(51) Int. Cl.
*F28F 1/40* (2006.01)
*F22B 37/10* (2006.01)
*B21C 1/22* (2006.01)

(52) U.S. Cl.
CPC ..... *F22B 37/103* (2013.01); *B21C 1/22* (2013.01)

(58) Field of Classification Search
CPC .... F28F 9/013; F28F 1/10; F28F 1/126; F28F 1/36; F28F 1/40; F28F 1/405; F16L 55/02736; F16L 9/042; F16L 9/047; F16L 11/10; F15D 1/02; F15D 1/04; B21C 37/06; B21C 37/20; B21C 37/207; B21C 37/22; B21C 37/26; B21D 53/06
See application file for complete search history.

(56) References Cited

U.S. PATENT DOCUMENTS 3,267,564 A 8/1966 Keyes
3,272,961 A 9/1966 Maier, Jr. et al.
3,595,299 A * 7/1971 Weishaupt ..... F28F 9/24 159/28.5

(Continued)

FOREIGN PATENT DOCUMENTS

CH 549193 A * 5/1974 ..... B21C 37/20
CN 1165287 A 11/1997

(Continued)

OTHER PUBLICATIONS

International Search Report dated Jul. 21, 2017, for PCT/EP2017/059227.

*Primary Examiner* — Gregory A Wilson

(57) ABSTRACT

A steam generator pipe for producing a steam generator pipe with a spiral-shaped installation body, wherein an elevation extends on the inner side of the steam generation pipe in the axial direction of the steam generator pipe. A method for producing a steam generator pipe having an installation body.

5 Claims, 2 Drawing Sheets

(56) References Cited

U.S. PATENT DOCUMENTS

| | | | | | |
|---|---|---|---|---|---|
| 3,719,207 | A * | 3/1973 | Takeda | F16L 55/00 | 366/181.5 |
| 3,776,018 | A * | 12/1973 | French | F28F 1/40 | 29/890.048 |
| 4,314,587 | A | 2/1982 | Hackett | | |
| 4,660,630 | A * | 4/1987 | Cunningham | F28F 1/42 | 29/890.048 |
| 4,794,983 | A * | 1/1989 | Yoshida | F28D 15/046 | 165/133 |
| 4,798,241 | A * | 1/1989 | Jarrett | B01F 5/0614 | 138/38 |
| 5,085,826 | A | 2/1992 | Oosterkamp | | |
| 5,690,167 | A | 11/1997 | Rieger | | |
| 5,704,424 | A | 1/1998 | Kohno et al. | | |
| 6,250,257 | B1 | 6/2001 | Kastner et al. | | |
| 6,533,030 | B2 * | 3/2003 | Mitrovic | F28F 1/40 | 138/38 |
| 6,536,380 | B1 * | 3/2003 | Kral | F22B 21/346 | 122/406.3 |
| 6,883,597 | B2 * | 4/2005 | Thors | F28F 1/40 | 165/184 |
| 8,122,856 | B2 * | 2/2012 | Franke | F22B 37/18 | 122/235.17 |
| 9,611,967 | B2 * | 4/2017 | Dugan | F16L 53/30 | |
| 9,863,724 | B2 * | 1/2018 | Schoubye | F28F 13/12 | |
| 10,458,446 | B1 * | 10/2019 | Schmidt | F16L 55/02772 | |
| 10,996,005 | B2 * | 5/2021 | Gotterbarm | F28F 1/18 | |
| 2004/0074724 | A1 * | 4/2004 | Bruck | F28F 1/405 | 188/378 |
| 2008/0078535 | A1 | 4/2008 | Bunker et al. | | |
| 2009/0050307 | A1 | 2/2009 | Franke et al. | | |
| 2009/0095236 | A1 | 4/2009 | Franke et al. | | |
| 2013/0087106 | A1 | 4/2013 | Bruckner et al. | | |
| 2014/0083668 | A1 * | 3/2014 | Deng | F28F 1/40 | 165/181 |
| 2015/0290737 | A1 | 10/2015 | Brueckner et al. | | |
| 2018/0142827 | A1 * | 5/2018 | Farrow | F15D 1/02 | |

FOREIGN PATENT DOCUMENTS

| | | | | |
|---|---|---|---|---|
| CN | 101223402 | A | 7/2008 | |
| CN | 101389904 | A | 3/2009 | |
| CN | 102933899 | A | 2/2013 | |
| CN | 103157694 | A | 6/2013 | |
| CN | 203798229 | U | 8/2014 | |
| CN | 203892732 | U | 10/2014 | |
| DE | 1452455 | A1 | 4/1969 | |
| DE | 3231318 | A1 | 3/1984 | |
| DE | 3222944 | C1 | 11/1987 | |
| DE | 4417524 | A1 | 11/1995 | |
| DE | 102008051812 | A1 | 4/2010 | |
| DE | 102012219898 | B4 | 9/2014 | |
| EP | 2390567 | A1 | 11/2011 | |
| JP | H0579782 | A | 3/1993 | |
| JP | 2003095923 | A | 4/2003 | |
| KR | 20000053090 | A | 8/2000 | |
| KR | 101332251 | B1 | 11/2013 | |
| RU | 2377490 | C1 | 12/2009 | |
| WO | 03095923 | A1 | 11/2003 | |
| WO | 2010-137647 | * | 12/2010 | |
| WO | 2011151135 | A2 | 12/2011 | |
| WO | WO-2016040827 | A1 * | 3/2016 | F25B 39/02 |

* cited by examiner

STEAM GENERATOR PIPE HAVING A TURBULENCE INSTALLATION BODY

CROSS REFERENCE TO RELATED APPLICATIONS

This application is the US National Stage of International Application No. PCT/EP2017/059227 filed Apr. 19, 2017, and claims the benefit thereof. The International Application claims the benefit of German Application No. DE 102016212416.1 filed Jul. 7, 2016. All of the applications are incorporated by reference herein in their entirety.

FIELD OF INVENTION

The invention relates to a method for producing a steam generator pipe having an installation body.

BACKGROUND OF INVENTION

Smooth pipes or internally ribbed pipes are used for evaporator heating surfaces in steam generators. The use of internally ribbed pipes may be necessary for various reasons: low full load mass flow density of the evaporator (for example BENSON low mass flux design), high heat flow density and risk of film boiling (for example drum-type boiler), avoidance of flow stratification in normal load operation (for example minimum load in evaporators with spiral pipes).

The internal ribbing of the pipes is produced by a cold drawing process according to the prior art. According to the current state of knowledge, internally ribbed pipes can be produced only with materials having a maximum chromium content of 5%. If it is necessary to use internally ribbed pipes composed of higher chromium alloyed steels, for example as a result of a further increase of the steam parameters, the internally ribbed pipes are not able to be produced with a consistently good quality using the production processes currently available.

Patent applications already made have proposed the replacement of the cold-drawn inner ribs by installation bodies. For example, the production and fitting of a swirl installation body in a smooth evaporator pipe is disclosed by WO 2011/151135 A2.

Furthermore, EP 2 390 567 A1 discloses a method for producing steam generator pipes, in which an installation body is fixed in grooves of a template shaft, the template shaft is inserted with the installation body into a steam generator pipe, the fixing of the installation body on the template shaft is released and the template shaft is removed from the steam generator pipe again.

Finally, DE 10 2012 219 898 B4 claims a resistance spot welding apparatus for fixing a swirl installation body on an inner wall of a steam generator pipe and discloses the application of the resistance spot welding method for producing a connection between the pipe and the installation body.

However, it is evident that there is a wide scatter of the quality of the welding results achieved with the resistance spot welding apparatus. The installation body has a high stiffness and it closely abuts the pipe inner wall to a large extent as soon as the template shaft has been screwed out of the pipe. However, the contact with the pipe wall is not provided with certainty at all locations owing to tolerances of the pipe and the installation body. Although the electrode of the welding lance presses, via a hydraulic cylinder, the wire of the installation body against the pipe inner wall already prior to the welding current being applied, it is not ensured that an electrically conductive contact surface between the installation body and the pipe inner side is produced precisely and only at the welding electrode.

SUMMARY OF INVENTION

It is an object of the invention to specify a method for producing a steam generator pipe having an insulation body.

The object directed at a method is achieved by a method for producing a steam generator pipe having an installation body, in which a steam generator pipe having an elevation which extends in the longitudinal direction of the steam generator pipe on a pipe inner side is produced, and the installation body is welded on the elevation in the steam generator pipe.

The invention is based on the finding that it is necessary for there to be a contact surface between the installation body and the pipe inner wall precisely at the welding electrode in order that a sufficiently good quality of the welding can be produced in a reproducible manner. According to the invention, it is therefore proposed that a relatively small elevation is produced on the pipe inner wall prior to the introduction of the swirl installation body, and that the welding of the installation body occurs precisely on this elevation.

The elevation gives rise to a defined location at which the local contact pressure by the electrode acts and at which the current flows during the welding.

The chromium content of the steam generator pipe is typically over 5%. In the case of steam generator pipes for steam generators having relatively large steam parameters, the use of steels having a chromium content of over 5% is necessary. Corresponding reliable production processes are not known, and so the additional effort for the provision of such a pipe having an elevation is justified.

The elevation is less than 1 mm in size in the radial direction in relation to the steam generator pipe. The elevation thus remains relatively small and essential merely has to compensate for production tolerances.

Here, it may be expedient for the steam generator pipe having an elevation to be produced by cold drawing. In a process on an industrial scale, it is thus possible for the particular form of the inner side to be integrated in a largely cost-neutral manner already in the production process of the semi-finished product.

It may alternatively be expedient for the elevation to be embossed using a stamp, in particular using a hydraulic stamp.

In both cases, elevations of a few tenths of a millimeter in size can thus be readily produced or embossed, on which the welding can then be realized with sufficient strength in the steam generator pipe.

In an advantageous embodiment of the invention, the installation body is spiral-shaped and is welded on the elevation at multiple points. In this way, it is possible, even for relatively larger steam parameters, for an internally ribbed steam generator pipe to be produced.

BRIEF DESCRIPTION OF THE DRAWINGS

The invention will be discussed in more detail by way of example on the basis of the drawings. In the drawings, in each case schematically and not to scale.

DETAILED DESCRIPTION OF INVENTION

Figure 1:
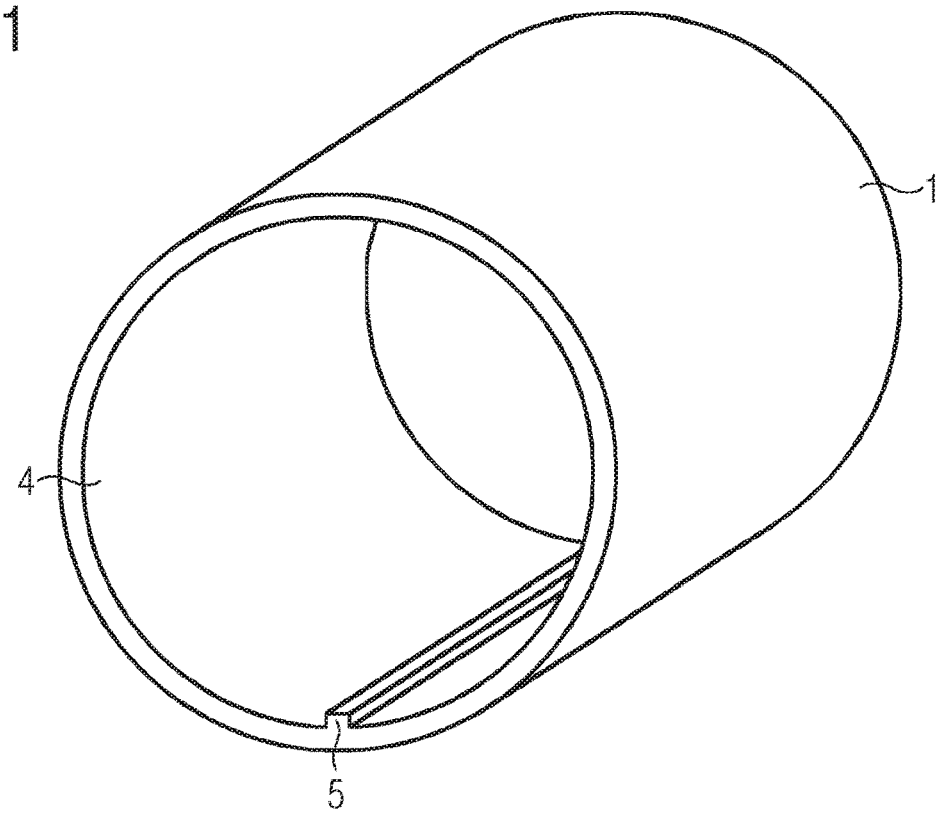
FIG. 1 shows a steam generator pipe with an elevation.
Figure 2:
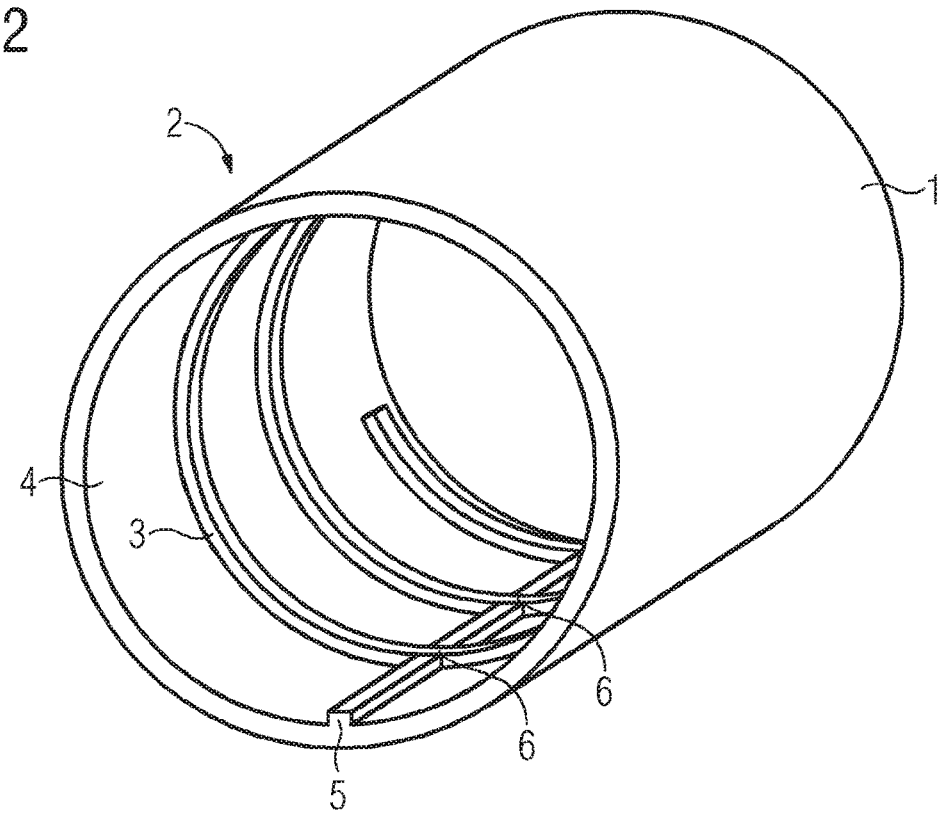
FIG. 2 shows a steam generator pipe with a spiral-shaped installation body.

FIG. 1 shows, schematically and by way of example, a steam generator pipe 1 for the production of a steam generator pipe 2 having a spiral-shaped installation body 3, which is shown in FIG. 2.

On the inner side 4 of the steam generator pipe 1 in FIG. 1, an elevation 5 extends in the axial direction of the steam generator pipe 1, specifically, as FIG. 2 shows, over the entire region in which the spiral-shaped installation body 3 is arranged. The installation body 3 is welded to the elevation 5 at multiple contact points 6.

Figure 3:
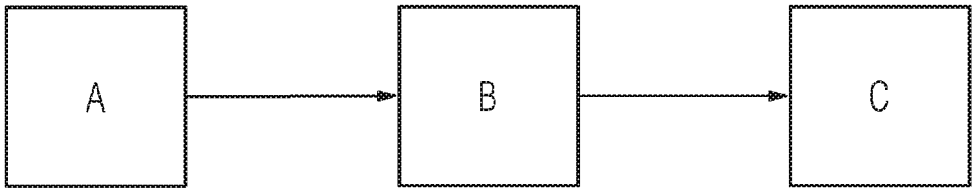
FIG. 3 shows a flow diagram of the method according to the invention.

FIG. 3 schematically shows the individual steps of the production method according to the invention. In step A, a steam generator pipe 1 having an elevation which extends in the longitudinal direction of the steam generator pipe on a pipe inner side is produced, for example by means of cold drawing. The object in FIG. 1 is thus formed. The installation body 3 is then firstly introduced in step B and subsequently welded on the elevation 5 in the steam generator pipe 1 in step C, with the result that a steam generator pipe 2 having an installation body 3 is formed. Since a swirl installation body 3 shown in FIG. 2 has multiple windings, it is also welded at multiple contact points 6 between the swirl installation body 3 and the elevation 5.

The invention claimed is:

1. A method for producing a steam generator pipe comprising an installation body, the method comprising:

producing a steam generator pipe comprising an elevation which is an integrally formed portion of the steam generator pipe and which extends in a longitudinal direction of the steam generator pipe on a pipe inner side, and welding the installation body on the elevation in the steam generator pipe such that the installation body is positioned radially inward of the elevation with respect to a longitudinal axis of the steam generator pipe, wherein the steam generator pipe comprising the elevation is produced by a cold drawing process that forms the elevation as the integrally formed portion of the steam generator pipe.

2. The method according to claim 1, wherein the installation body is spiral-shaped and is welded on the elevation at multiple contact points.

3. A method, comprising:

cold drawing a steam generator pipe comprising an elevation which is integrally formed in the steam generator pipe as part of the cold drawing, wherein the elevation extends in a longitudinal direction of the steam generator pipe on a pipe inner side, and welding an installation body on the elevation such that the installation body is positioned radially inward of the elevation with respect to a longitudinal axis of the steam generator pipe.

4. The method of claim 3, wherein a radial height of the elevation is not greater than one millimeter.

5. A method for producing a steam generator pipe comprising an installation body, the method comprising:

producing a steam generator pipe comprising an elevation which is an integrally formed portion of the steam generator pipe and which extends in a longitudinal direction of the steam generator pipe on a pipe inner side, and welding the installation body on the elevation in the steam generator pipe such that the installation body is positioned radially inward of the elevation with respect to a longitudinal axis of the steam generator pipe, wherein the installation body is spiral-shaped and is welded on the elevation at multiple contact points.

* * * * *